US007988498B1

(12) United States Patent
Lim et al.

(10) Patent No.: US 7,988,498 B1
(45) Date of Patent: Aug. 2, 2011

(54) EARPHONE JACK

(75) Inventors: Jong-In Lim, Gumpo-si (KR); Thomas A Hall, Lexington, TX (US)

(73) Assignee: Korea Air Electronics Co., Ltd, Kyunki-do (KR)

( * ) Notice: Subject to any disclaimer, the term of this patent is extended or adjusted under 35 U.S.C. 154(b) by 0 days.

(21) Appl. No.: 13/004,502

(22) Filed: Jan. 11, 2011

(30) Foreign Application Priority Data

Dec. 6, 2010 (KR) ..... 10-2010-0123222

(51) Int. Cl.
*H01R 24/04* (2006.01)

(52) U.S. Cl. ..... 439/669; 439/668

(58) Field of Classification Search ..... 439/668–669
See application file for complete search history.

(56) References Cited

U.S. PATENT DOCUMENTS 4,364,625 A * 12/1982 Baker et al. ..... 439/188
4,367,907 A * 1/1983 Buck ..... 439/188
4,548,447 A * 10/1985 Dinsmore ..... 439/43
5,266,042 A * 11/1993 Hampel ..... 439/188
5,348,481 A * 9/1994 Ortiz ..... 439/25
5,376,206 A * 12/1994 Maurer et al. ..... 156/242
6,390,856 B1 * 5/2002 D'Addario et al. ..... 439/668
6,461,199 B1 * 10/2002 Koga et al. ..... 439/668
6,533,617 B1 * 3/2003 D'Addario ..... 439/669
6,607,406 B2 * 8/2003 Banas et al. ..... 439/668
7,407,416 B1 * 8/2008 Rogers et al. ..... 439/669
2004/0242076 A1 * 12/2004 Nakai et al. ..... 439/668
2009/0149080 A1 * 6/2009 Wu ..... 439/668

* cited by examiner

*Primary Examiner* — Briggitte R Hammond
*Assistant Examiner* — Larisa Z Tsukerman
(74) *Attorney, Agent, or Firm* — Sughrue Mion, PLLC

(57) ABSTRACT

Disclosed is an earphone jack including a housing, a circuit connector mounted in the housing, and a plurality of first connecting terminals each including a first connecting section outwardly protruded from the housing, to be connected to a circuit of an audio appliance, and a second connecting section extending from the first connecting section while being bent to have a C shape such that the second connecting section elastically fits around an associated one of the connecting terminals of the earphone plug. It is possible to elastically support the earphone plug even after the earphone plug is repeatedly inserted into and separated from the housing, because the first connecting terminals have a structure bent to have a circular shape.

6 Claims, 5 Drawing Sheets

5

EARPHONE JACK

BACKGROUND OF THE INVENTION

1. Field of the Invention

The present invention relates to an earphone jack, and more particularly to an earphone jack capable of maintaining the elasticity of a circuit connector, to which an earphone plug is connected.

2. Description of the Related Art

Generally, an earphone, headphone, or speaker is used for an appliance such as a miniature audio appliance, a mobile communication terminal, or a personal multimedia appliance, to be connected to the appliance, and thus to allow the user to listen to an audio signal reproduced from the appliance.

In particular, the earphone is applied to various portable audio appliances because it is miniature and conveniently portable. The user can listen to an audio signal output from a portable audio appliance by inserting a plug provided at the earphone into an earphone jack provided at the portable audio appliance.

An earphone jack, which has the above-mentioned function, is disclosed in Korean Utility Model No. 20-0385067. The disclosed earphone jack includes connecting terminals corresponding to respective terminals of a plug. When the plug is inserted into the earphone jack, the plug comes into contact with arc-shaped contact plates of the connecting terminals, so that the terminals of the plug are electrically connected to the connecting terminals, respectively.

However, the disclosed earphone jack has a problem in that the elasticity of the contact plates of the connecting terminals may be degraded after repeated insertion of the plug into the earphone jack for a prolonged period of time.

SUMMARY OF THE INVENTION

Therefore, the present invention has been made in view of the above-mentioned problem, and an object of the present invention is to provide an earphone jack capable of maintaining the elasticity of a circuit connector, to which a plug of an earphone is connected, even after the earphone plug is repeatedly inserted into the earphone jack.

In accordance with one aspect, the present invention provides an earphone jack including a cylindrical housing, into which an earphone plug having a plurality of connecting terminals is inserted to be seated in the cylindrical housing, a circuit connector mounted in the housing, to be electrically connected to a circuit of an audio appliance, the circuit connector being connected to the connecting terminals of the earphone plug, wherein the circuit connector includes a plurality of first connecting terminals each including a first connecting section outwardly protruded from the housing, to be connected to the circuit of the audio appliance, and a second connecting section extending from the first connecting section while being bent to have a C shape such that the second connecting section elastically fits around an associated one of the connecting terminals of the earphone plug, wherein the housing includes a first housing partially opened at a top portion thereof, and a second housing having a semi-cylindrical shape, the second housing being coupled to the first housing, to cover the opened top portion of the first housing, wherein each of the first and second housings is formed with a plurality of seating grooves, in which the first connecting terminals are seated, respectively, the first connecting terminals being first seated in the seating grooves of the first housing, and then seated in the seating grooves of the second housing when the second housing covers the opened top portion of the first housing.

A plurality of contact protrusions may be formed at an inner surface of the second connecting section of each first connecting terminal. The contact protrusions may be protruded toward the earphone plug inserted into the housing, to connect the second connecting section to the earphone plug.

The first housing may be formed with mounting grooves, in which the first connecting sections are mounted, respectively. The first connecting sections may be outwardly protruded from the mounting grooves, respectively.

The circuit connector may further include a second connecting terminal to be connected to the connecting terminal of the earphone plug, which is arranged at a front end of the earphone plug, when the earphone plug is inserted into the housing. The second connecting terminal may include a body radially spaced apart from a periphery of a front end of the earphone plug by a predetermined distance, the body having a cut-out portion, an inserting section extending rearwards from the body, the inserting section being inserted into a receiving groove formed at a front end of the first housing, a third connecting section extending from the body toward one side surface of the first housing, to be outwardly protruded from the first housing, and to be connected to the circuit of the audio appliance, and a plurality of fourth connecting sections extending forwardly from the body, to be connected to an outer surface of the front end of the earphone plug.

The circuit connector may further include a third connecting terminal, which is connected to the connecting terminal of the earphone plug arranged at the front end of the earphone plug when the earphone plug is inserted into the housing, to sense the insertion of the earphone plug. The third connecting terminal may include a fifth connecting section arranged at the cut-out portion of the body of the second connecting terminal, the fifth connecting section extending through the cut-out portion such that such that the fifth connecting section is inserted into a receiving groove formed at the first housing, and is then outwardly protruded from the first housing, to be connected to the circuit of the audio appliance, and a sixth connecting section extending forwardly from the fifth connecting section, to be connected to the outer surface of the front end of the earphone plug.

The housing may further include a third housing arranged at a front end of the first housing. The third housing may be formed with a receiving portion, in which the fourth connecting sections of the second connecting terminal and the sixth connecting section of the third connecting terminal are received.

In the earphone jack having the above-described configuration according to the present invention, it may be possible to elastically support the earphone plug even after the earphone plug is repeated inserted into and separated from the housing, because the second connecting section of each first connecting terminal has a structure bent to have a C shape.

BRIEF DESCRIPTION OF THE DRAWINGS

The above objects, and other features and advantages of the present invention will become more apparent after a reading of the following detailed description when taken in conjunction with the drawings, in which.

DESCRIPTION OF THE PREFERRED EMBODIMENTS

Now, preferred embodiments of the present invention relating to an earphone jack will be described in detail with reference to the annexed drawings.

Figure 1:
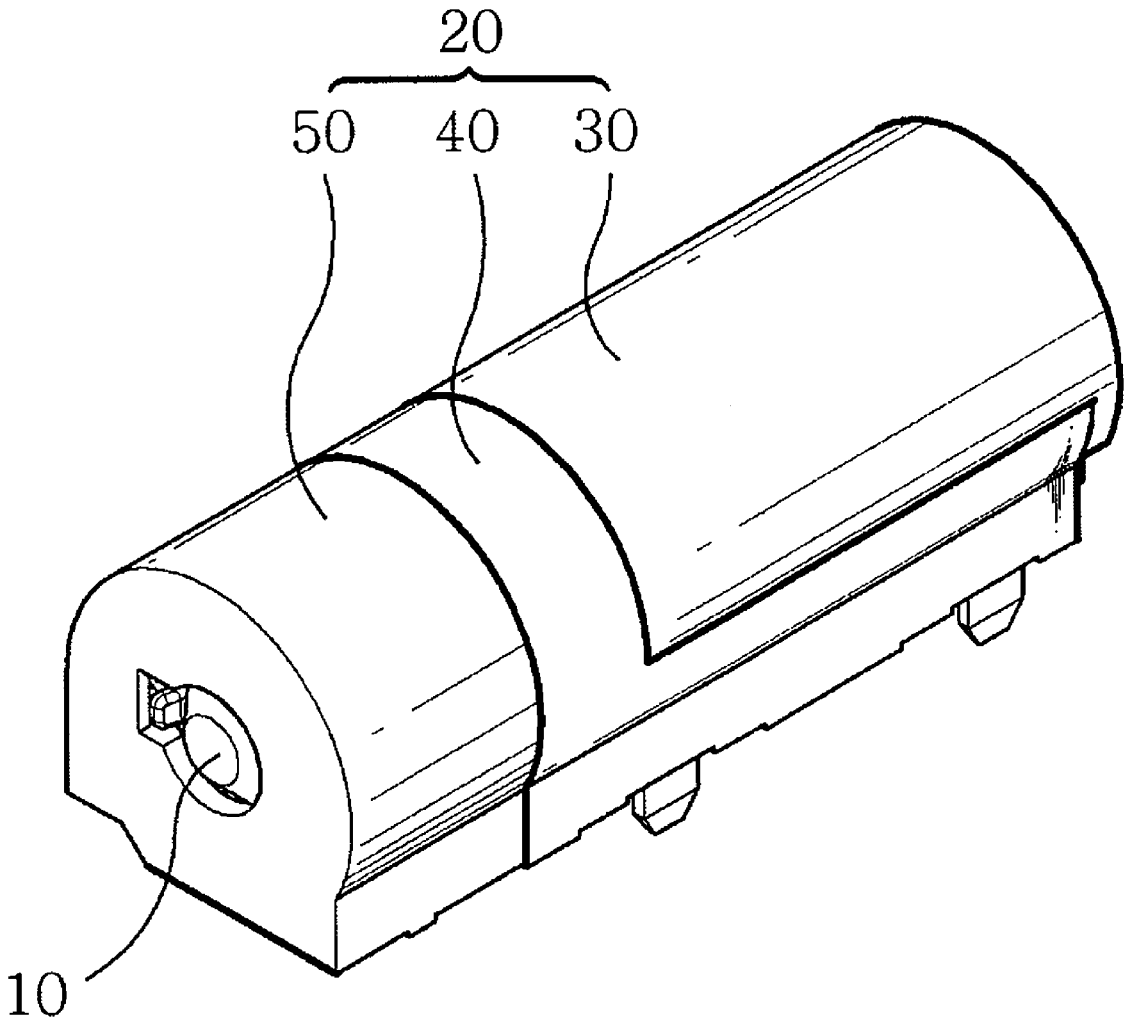
FIG. 1 is a perspective view illustrating an earphone jack according to an exemplary embodiment of the present invention.
Figure 2:
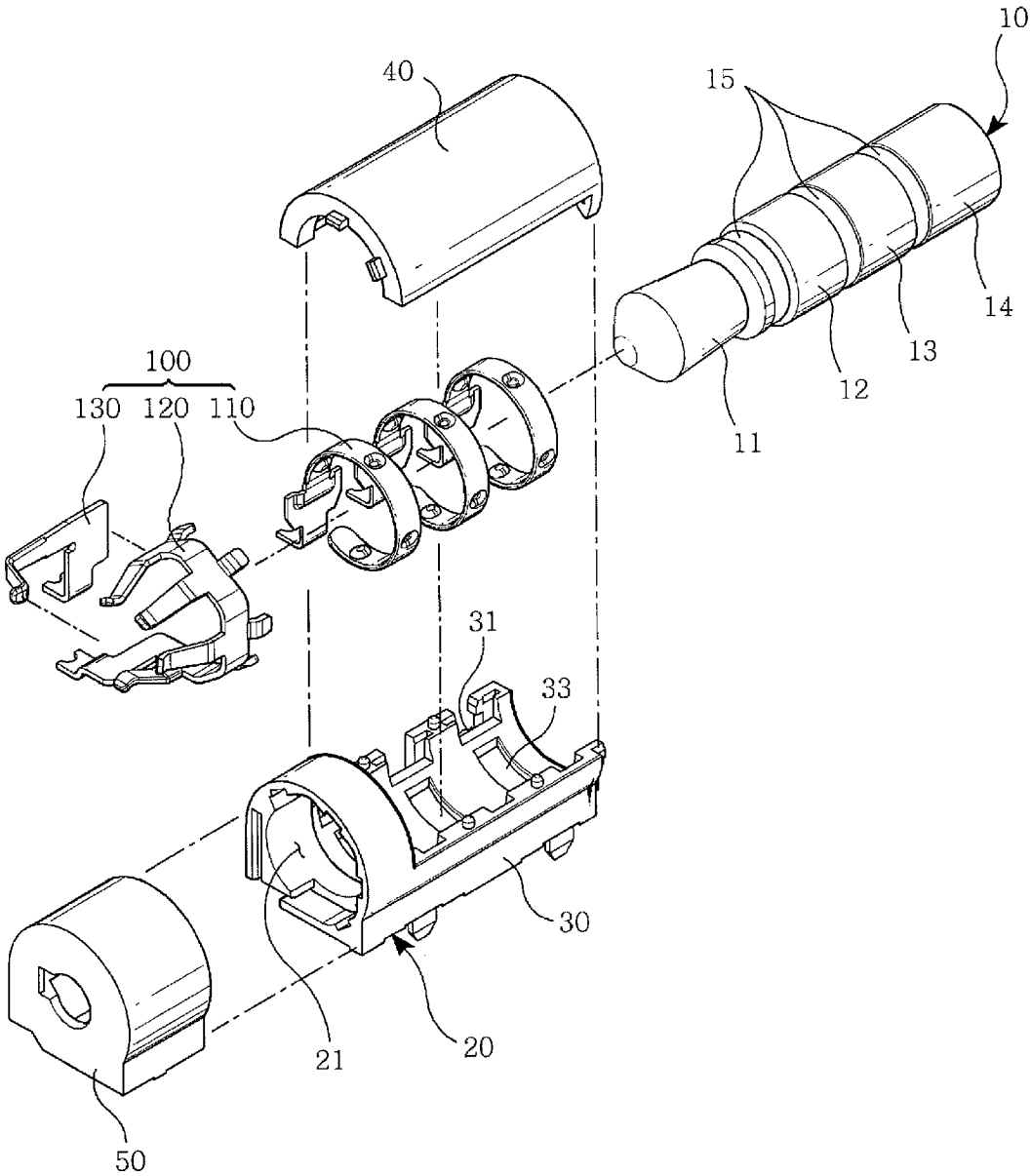
FIG. 2 is an exploded perspective view illustrating the earphone jack according to the exemplary embodiment of the present invention.
Figure 3:
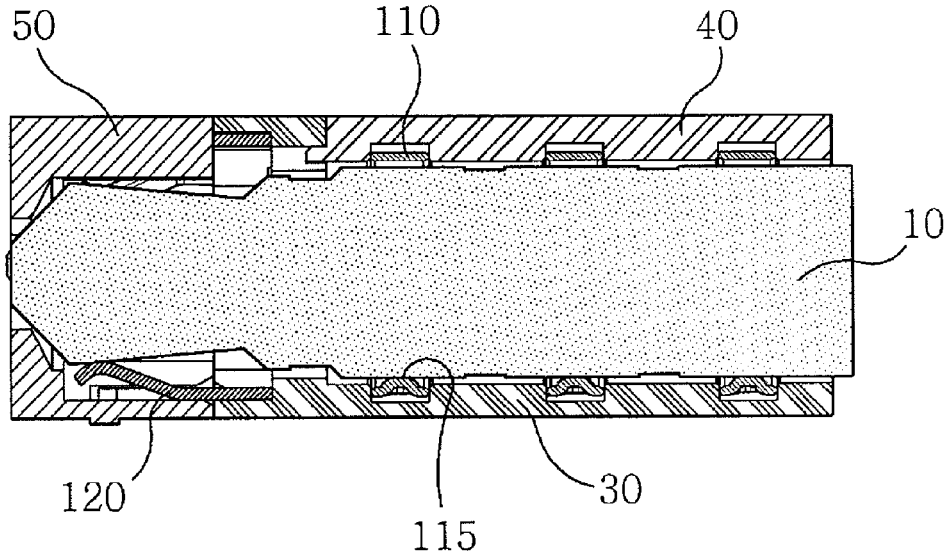
FIG. 3 is a sectional view illustrating the earphone jack according to the exemplary embodiment of the present invention.

Referring to FIGS. 1 to 3, an earphone jack according to an exemplary embodiment of the present invention is illustrated. As shown in FIGS. 1 to 3, the earphone jack includes a housing 20, into which an earphone plug 10 having a plurality of connecting terminals will be inserted, and a circuit connector 100 as a contact. The circuit connector 100 is mounted in the housing 20.

As described above, the earphone plug 10 includes a plurality of connecting terminals. For example, the earphone plug 10 may include a microphone terminal 11, a first speaker terminal 12, a second speaker terminal 13, and a ground terminal 14. An insulator 15 is interposed between adjacent ones of the terminals 11, 12, 13, and 14. That is, in the illustrated embodiment of the present invention, the earphone plug 10 includes four connecting terminals. However, the earphone plug 10 may have different numbers of connecting terminals in accordance with the use purpose thereof.

The housing 20 has a cylindrical shape to form a receiving hole 21, into which the earphone plug 10 may be smoothly inserted. The housing 20 includes a first housing 30 partially opened at a top portion thereof, a second housing 40 covering the opened top portion of the first housing 30, and a third housing 50 arranged at the front of the first and second housings 30 and 40.

As described above, the first housing is partially opened at the top portion thereof. The opened top portion of the first housing 30 has a semi-cylindrical shape. Preferably, the semi-cylindrical opened top portion of the first housing 30 is formed at a region arranged near the receiving hole 21, into which the earphone plug 10 is inserted, as shown in the drawings. The remaining portion of the first housing 30, the top of which is not opened, has a cylindrical shape.

The first housing 30 is formed with mounting grooves 31, in which respective first connecting sections 111 (FIG. 4) of first connecting terminals 110 included in the circuit connector 100 are mounted, and seating grooves 33, in which respective second connecting sections 113 (FIG. 4) of the first connecting terminals 110 are seated. The first connecting terminals 110 will be described later. Also, the mounting groove 31 and seating groove 33 will be described in detail later.

The second housing 40 covers the semi-cylindrical opened top portion of the first housing 30. To this end, the second housing 40 has a semi-cylindrical shape. Similarly to the first housing 30, the second housing 40 includes seating grooves 43 (FIG. 5) in which respective second connecting sections 113 of the first connecting terminals 110 are seated. The coupling between the first and second housings 30 and 40 may be achieved through at least one of a method using a coupling protrusion formed at one of the first and second housings 30 and 40 and a coupling groove formed at the other one of the first and second housings 30 and 40, a method using engagement members respectively formed at the first and second housings 30 and 40, to be engaged with each other, and a method for fusing contact portions of the first and second housings 30 and 40, using ultrasonic waves.

The third housing 50 is arranged at a front end of the first housing 30. In the third housing 50, second and third connecting terminals 120 and 130 of the circuit connector 100, which will be described later, are received. To this end, the third housing 50 is formed, at a rear end thereof, with a receiving portion 51 (FIG. 6) having a shape corresponding to those of the second and third connecting terminals 120 and 130, to receive the second and third connecting terminals 120 and 130. Similarly to the coupling between the first and second housings, the coupling between the first and third housings 30 and 50 may be achieved through at least one of a method using a coupling protrusion and a coupling groove, a method using engagement members, and an ultrasonic fusing method.

The circuit connector 100 includes a plurality of first connecting terminals 110, which are mounted in the first and second housings 30 and 40, and second and third connecting terminals 120 and 130 mounted in the first housing 30 while being inserted into the third housing 50.

As shown in the drawings, there are a plurality of first connecting terminals 110. The plural first connecting terminals are connected to selected connecting terminals of the earphone plug 10, namely, the first speaker terminal 12, second speaker terminal 13, and ground terminal 14, respectively.

Figure 4:
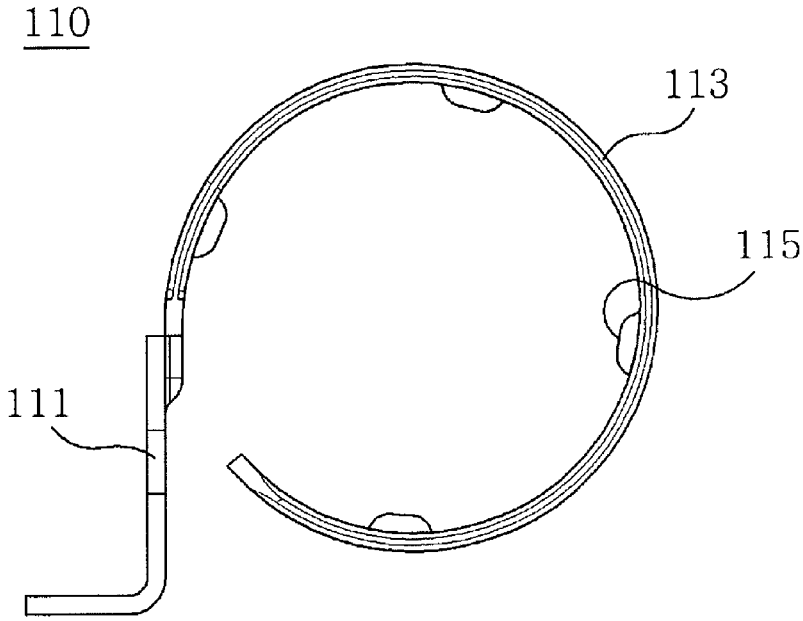
FIG. 4 is a front view illustrating a first connecting terminal of the earphone jack according to the exemplary embodiment of the present invention.

Hereinafter, the shape of each first connecting terminal 110 will be described with reference to FIGS. 2 and 4.

Each first connecting terminal 110 includes a first connecting section 111 to be connected to a circuit of an audio appliance (not shown), to which the earphone jack is applied, and a second connecting section 113 extending from the first connecting section 111, and adapted to be connected to one connecting terminal of the earphone plug 10.

The first connecting section 111 has an L shape. One end of the first connecting section 111 extends toward one side surface of the first housing 30 such that it is outwardly protruded from the first housing 30. The end of the first connecting section 111 outwardly protruded from the first housing 30 is connected to the circuit of the audio appliance. The first housing 30 is formed with the mounting groove 31, in order to allow the first connecting section 111 to be outwardly protruded from the first housing 30.

The second connecting section 113, which extends from the first connecting section 111, has a structure bent to have a C shape. As the second connecting section 113 has a structure bent to have a C shape, it may elastically fit around one connecting terminal of the earphone plug 10. The second connecting section 113, which has a structure bent to have a C shape, is seated in the seating grooves 33 and 43 respectively formed at the first and second housings 30 and 40.

A plurality of contact protrusions 115 are formed at an inner surface of the second connecting section 113. The contact protrusions 115 come into direct contact with the associated connecting terminal of the earphone plug 10 when the earphone plug 10 is inserted into the housing 20.

That is, in the illustrated embodiment of the present invention, it may be possible to elastically support the earphone plug 10 even after the earphone plug 10 is repeatedly inserted into and separated from the housing 20 for a prolonged period of time, because the second connecting section 113 of each first connecting terminal 110 has a structure bent to have a C shape.

Figure 5:
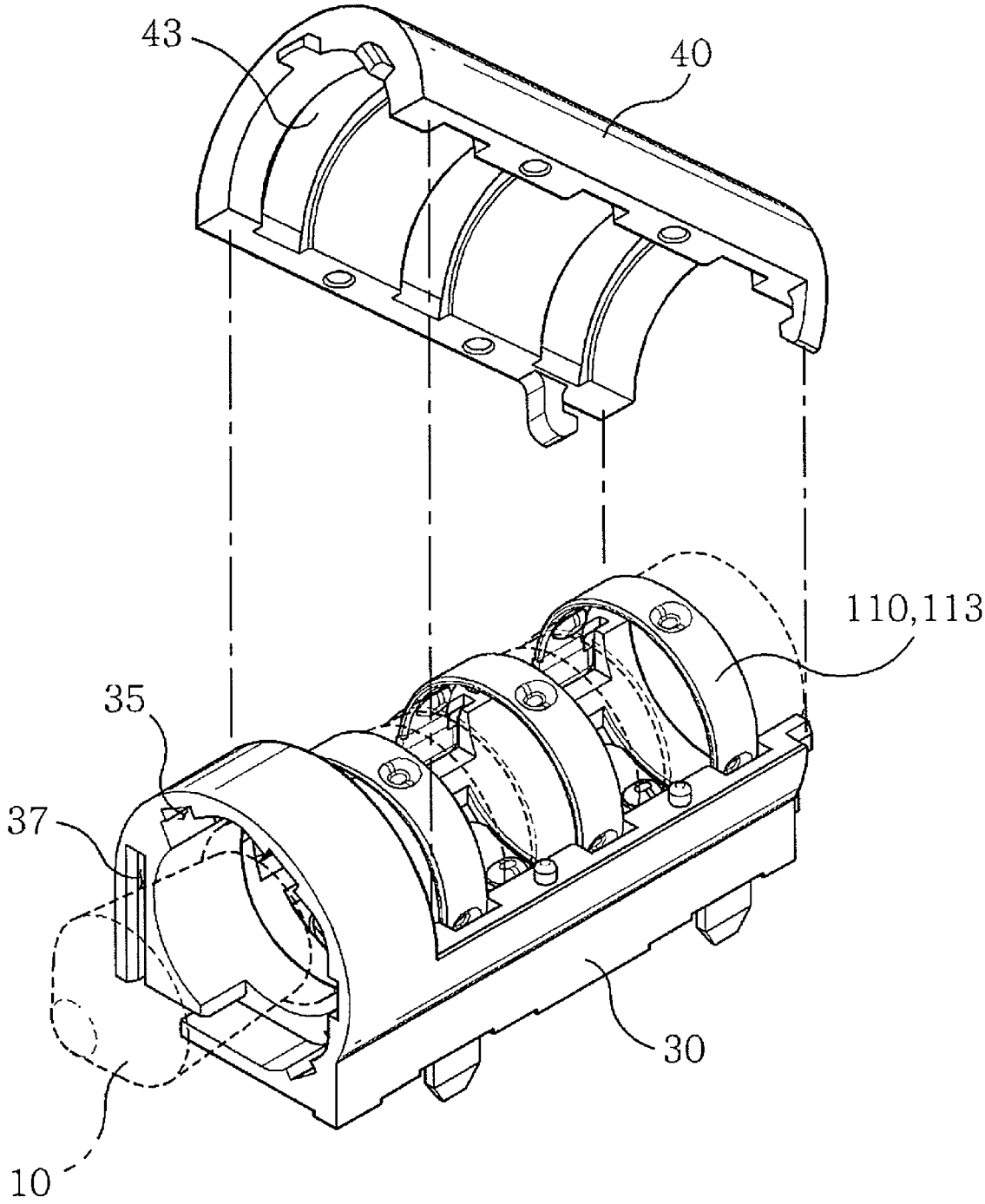
FIG. 5 is an exploded perspective view for explaining a procedure for mounting the first connecting terminal of the earphone jack according to the exemplary embodiment of the present invention.

The procedure of mounting each first connecting terminal 110 in the first and second housings 30 and 40 in the illustrated embodiment of the present invention will be described with reference to FIG. 5.

First, the first connecting section 111 of each first connecting terminal 110 is mounted in a selected one of the mounting grooves 31 of the first housing 30. At the same time, a portion of the second connecting section 113 of the first connecting terminal 110 is seated in a selected one of the seating grooves 33 of the first housing 30. Thereafter, the second housing 40 is disposed on the first housing 30, to cover the opened top portion of the first housing 30 while seating the remaining portion of the second connecting section 113 of each first connecting terminal 110 in a selected one of the seating grooves 43 of the second housing 40.

In the illustrated embodiment of the present invention, accordingly, it may be possible to easily mount the first connecting terminals 110 in the first and second housings 30 and 40 by first seating portions of the first connecting terminals 110 in the seating grooves 31 of the first housing 30, and then seating the remaining portions of the first connecting terminals 110 in the seating grooves 43 of the second housing 40 in the procedure of covering the opened top portion of the first housing 30 by the second housing 40.

As described above, the second connecting terminal 120 is connected to the associated connecting terminal of the earphone plug 10, which is arranged at the front end of the earphone plug 10, when the earphone plug 10 is inserted into the housing 20. Here, the connecting terminal arranged at the front end of the earphone plug 10 may be a microphone terminal.

Hereinafter, the shape of the second connecting terminal 120 will be described with reference to FIG. 6.

The second connecting terminal 120 includes a body 121, a plurality of inserting sections 123 extending rearwards from the body 121, a third connecting section 125 extending laterally from the body 121, and a plurality of fourth connecting sections 127 extending forwardly from the body 121.

Figure 6:
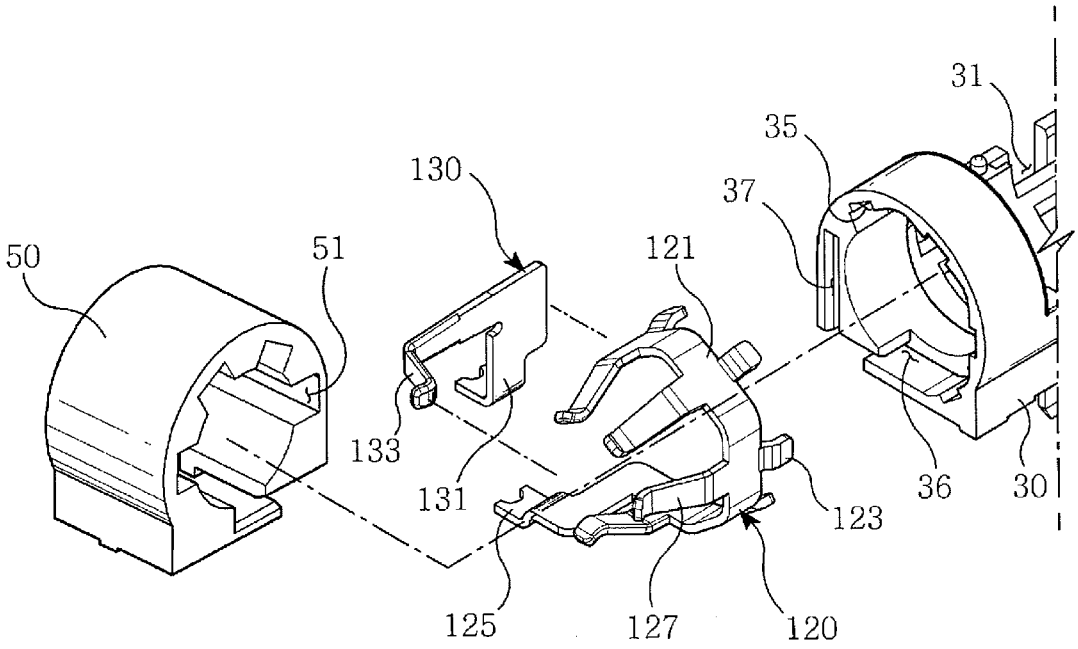
FIG. 6 is an exploded perspective view for explaining a procedure for mounting second and third connecting terminals of the earphone jack according to the exemplary embodiment of the present invention.

As shown in FIG. 6, the body 121 is configured to be radially spaced apart from the periphery of the front end of the earphone plug 10 by a certain distance. The body 120 has a structure cut out at a portion thereof. Thus, the body 121 may have a polygonal structure cut out at a portion thereof, as shown in the drawings, or may have a ring structure cut out at a portion thereof.

As described above, a plurality of inserting sections 123 extend rearwards from the body 121. The inserting sections 123 are inserted into receiving grooves 35 formed at the front end of the first housing 30, respectively. That is, in the illustrated embodiment of the present invention, the second connecting terminal 120 is maintained in a state of being fixed to the first housing 30 as the inserting sections 123 are inserted into the receiving grooves 35 of the first housing 30, respectively.

The third connecting section 125 extends from the body 121 toward one side surface of the first housing 30. The third connecting section 125, which extends toward one side surface of the first housing 30, is outwardly protruded from the first housing 30 through a mounting groove 36 formed at the first housing 30, so as to be connected to the circuit of the audio appliance.

As described above, a plurality of fourth connecting sections 127 extend forwardly from the body 121. The fourth connecting sections 127 are connected to an outer surface of the front end of the earphone plug 10, namely, the connecting terminal 11. As shown in the drawings, the fourth connecting sections 127 are arranged to be forwardly exposed from the first housing 30. The portions of the fourth connecting sections 127 forwardly exposed from the first housing 30 is received in the receiving portion 51 formed in the third housing 50.

As described above, the third connecting terminal 130 is arranged at the cut-out portion of the body 121 of the second connecting terminal 120. When the earphone plug 10 is inserted into the housing 20, the third connecting terminal 130 is connected to the connecting terminal of the earphone plug 10 arranged at the front end of the earphone plug 10, as described above.

Hereinafter, the shape of the third connecting terminal 130 will be described with reference to FIG. 6.

The third connecting terminal 130 includes a fifth connecting section 131 to be connected to the circuit of the audio appliance, and a sixth connecting section 133 extending from the fifth connecting section 131, to be connected to the connecting terminal of the earphone plug 10 arranged at the front end of the earphone plug 10.

As described above, the fifth connecting section 131 is arranged at the cut-out portion of the body 121 of the second connecting terminal 120. The fifth connecting section 131 has an L shape such that it is inserted into a receiving groove 37 formed at the first housing 30, and is then outwardly protruded from the first housing 30.

The sixth connecting section 133 extends forwardly from the fifth connecting section 131, to be connected to the front connecting terminal of the earphone plug 10. The sixth connecting section 133 functions to sense whether or not the earphone plug 10 is inserted. As shown in FIG. 6, the sixth connecting section 133 is arranged to be forwardly exposed from the first housing 30. Similarly to the fourth connecting sections 127, the sixth connecting section 133, which is forwardly exposed from the first housing 30, is received in the receiving portion 51 formed in the third housing 50.

As apparent from the above description, in accordance with the present invention, it may be possible to elastically support the earphone plug even after the earphone plug is repeated inserted into and separated from the housing for a prolonged period of time, because the second connecting section of each first connecting terminal has a structure bent to have a C shape.

In accordance with the present invention, it may also possible to easily mount the first connecting terminals in the first and second housings by first seating portions of the first connecting terminals in the first housing, and then seating the remaining portions of the first connecting terminals in the second housing in a procedure of covering an opened top portion of the first housing by the second housing.

Although the preferred embodiments of the invention have been disclosed for illustrative purposes, those skilled in the art will appreciate that various modifications, additions and substitutions are possible, without departing from the scope and spirit of the invention as disclosed in the accompanying claims.

What is claimed is:

1. An earphone jack comprising:

a cylindrical housing, into which an earphone plug having a plurality of connecting terminals is inserted to be seated in the cylindrical housing;

a circuit connector mounted in the housing, to be electrically connected to a circuit of an audio appliance, the circuit connector being connected to the connecting terminals of the earphone plug, wherein the circuit connector comprises a plurality of first connecting terminals each comprising a first connecting section outwardly protruded from the housing, to be connected to the circuit of the audio appliance, and a second connecting section extending from the first connecting section while being bent to have a C shape such that the second connecting section elastically fits around an associated one of the connecting terminals of the earphone plug, wherein the housing comprises a first housing partially opened at a top portion thereof, and a second housing having a semi-cylindrical shape, the second housing being coupled to the first housing, to cover the opened top portion of the first housing, wherein each of the first and second housings is formed with a plurality of seating grooves, in which the first connecting terminals are seated, respectively, the first connecting terminals being first seated in the seating grooves of the first housing, and then seated in the seating grooves of the second housing when the second housing covers the opened top portion of the first housing.

2. The earphone jack according to claim 1, wherein a plurality of contact protrusions are formed at an inner surface of the second connecting section of each first connecting terminal, the contact protrusions being protruded toward the earphone plug inserted into the housing, to connect the second connecting section to the earphone plug.

3. The earphone jack according to claim 1, wherein the first housing is formed with mounting grooves, in which the first connecting sections are mounted, respectively, the first connecting sections being outwardly protruded from the mounting grooves, respectively.

4. The earphone jack according to claim 1, wherein:

the circuit connector further comprises a second connecting terminal to be connected to the connecting terminal of the earphone plug, which is arranged at a front end of the earphone plug, when the earphone plug is inserted into the housing; and the second connecting terminal comprises a body radially spaced apart from a periphery of a front end of the earphone plug by a predetermined distance, the body having a cut-out portion, an inserting section extending rearwards from the body, the inserting section being inserted into a receiving groove formed at a front end of the first housing, a third connecting section extending from the body toward one side surface of the first housing, to be outwardly protruded from the first housing, and to be connected to the circuit of the audio appliance, and a plurality of fourth connecting sections extending forwardly from the body, to be connected to an outer surface of the front end of the earphone plug.

5. The earphone jack according to claim 4, wherein:

the circuit connector further comprises a third connecting terminal, which is connected to the connecting terminal of the earphone plug arranged at the front end of the earphone plug when the earphone plug is inserted into the housing, to sense the insertion of the earphone plug; and the third connecting terminal comprises a fifth connecting section arranged at the cut-out portion of the body of the second connecting terminal, the fifth connecting section extending through the cut-out portion such that such that the fifth connecting section is inserted into a receiving groove formed at the first housing, and is then outwardly protruded from the first housing, to be connected to the circuit of the audio appliance, and a sixth connecting section extending forwardly from the fifth connecting section, to be connected to the outer surface of the front end of the earphone plug.

6. The earphone jack according to claim 5, wherein:

the housing further comprises a third housing arranged at a front end of the first housing; and the third housing is formed with a receiving portion, in which the fourth connecting sections of the second connecting terminal and the sixth connecting section of the third connecting terminal are received.

* * * * *